US010452018B2

(12) United States Patent
Maeda et al.

(10) Patent No.: US 10,452,018 B2
(45) Date of Patent: Oct. 22, 2019

(54) PAPER DUST COLLECTING MEMBER AND IMAGE FORMING APPARATUS THEREWITH

(71) Applicant: KYOCERA Document Solutions Inc., Osaka (JP)

(72) Inventors: Hiroyuki Maeda, Osaka (JP); Yoshiaki Tashiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/176,722

(22) Filed: Oct. 31, 2018

(65) Prior Publication Data

US 2019/0146403 A1 May 16, 2019

(30) Foreign Application Priority Data

Nov. 10, 2017 (JP) ..... 2017-217240

(51) Int. Cl.
*G03G 21/00* (2006.01)
*G03G 15/00* (2006.01)

(52) U.S. Cl.
CPC ..... *G03G 21/0058* (2013.01); *G03G 15/6529* (2013.01); *G03G 21/007* (2013.01); *G03G 2221/0042* (2013.01); *G03G 2221/0068* (2013.01)

(58) Field of Classification Search
CPC ..... G03G 21/007; G03G 21/0058; G03G 2221/0042; G03G 2221/0057; G03G 2221/0068
See application file for complete search history.

(56) References Cited

U.S. PATENT DOCUMENTS

2015/0268609 A1* 9/2015 Yamada ..... B65H 3/00 399/328

FOREIGN PATENT DOCUMENTS

JP 2017-1875 A 1/2017

* cited by examiner

*Primary Examiner* — Erika J Villaluna
(74) *Attorney, Agent, or Firm* — Stein IP, LLC

(57) ABSTRACT

A paper dust collecting member removes and collects paper dust attached to a conveying roller, and is attachable along the attaching direction parallel to the axial direction of the conveying roller via an opening portion provided in a side plate of an apparatus main body. The paper dust collecting member has a removing member and a holding member. The removing member removes paper dust attached to the conveying roller. The holding member holds the removing member. The holding member includes a protrusion portion which is disposed, on its distal end portion side, along a side surface of the removing member and which protrudes in the thickness direction of the removing member beyond a contact surface of the removing member.

8 Claims, 6 Drawing Sheets

PAPER DUST COLLECTING MEMBER AND IMAGE FORMING APPARATUS THEREWITH

INCORPORATION BY REFERENCE

This application is based upon and claims the benefit of priority from the corresponding Japanese Patent Application No. 2017-217240 filed on Nov. 10, 2017, the contents of which are hereby incorporated by reference.

BACKGROUND

The present disclosure relates to a paper dust collecting member, and to an image forming apparatus provided with one. More particularly, the present disclosure relates to a paper dust collecting member for collecting paper dust attached to a roller, and to an image forming apparatus provided with one.

Conventionally common image forming apparatuses using an electrophotographic process typically use a process involving visualizing an electrostatic latent image formed on an image carrier such as a photosensitive drum using a developing device, transferring the visualized image (toner image) to a sheet, and then fixing the image.

The sheet is conveyed through a sheet conveying passage using a roller. Meanwhile, paper dust is generated due to friction between the sheet and the roller. In particular, a registration roller pair that corrects a skew in the sheet and conveys the sheet to an image forming portion in coordination with the timing of image formation needs to nip the sheet with a strong force, and thus is likely to generate paper dust.

There are known image formation apparatuses provided with a paper dust collecting member that contacts with the outer circumferential surface of the registration roller pair to collect paper dust on the outer circumferential surface of the registration roller pair. The paper dust collecting member includes, for example, a removing member comprising sponge that contacts with the outer circumferential surface of one roller of the registration roller pair to remove paper dust, and a holding member to which the removing member is attached. The holding member is provided with a paper dust receiving portion that receives paper dust removed by the removing member.

In this image forming apparatus, for example, when a predetermined time passes, the paper dust collecting member is pulled out in the axial direction of the registration roller pair and is replaced with a new paper dust collecting member.

SUMMARY

A paper dust collecting member according to one aspect of the present disclosure is disposed in an apparatus main body, and removes and collects paper dust attached to a conveying roller, and is attachable along the attaching direction parallel to the axial direction of the conveying roller via an opening portion provided in a side plate of the apparatus main body. The paper dust collecting member has a removing member and a holding member. The removing member extends in the axial direction of the conveying roller and removes paper dust by being disposed so as to contact with the outer circumferential surface of the conveying roller. The holding member holds, on its mounting surface, the removing member. The removing member includes a contact surface which makes contact with the outer circumferential surface of the conveying roller. The holding member includes a protrusion portion which is disposed, on its distal end portion side, along a side surface of the removing member, and the protrusion portion protrudes in the thickness direction of the removing member beyond the contact surface of the removing member.

This and other objects of the present disclosure, and the specific benefits obtained according to the present disclosure, will become apparent from the description of embodiments which follows.

DETAILED DESCRIPTION

Embodiments of the present disclosure will be described below with reference to the accompanying drawings.

Figure 1:
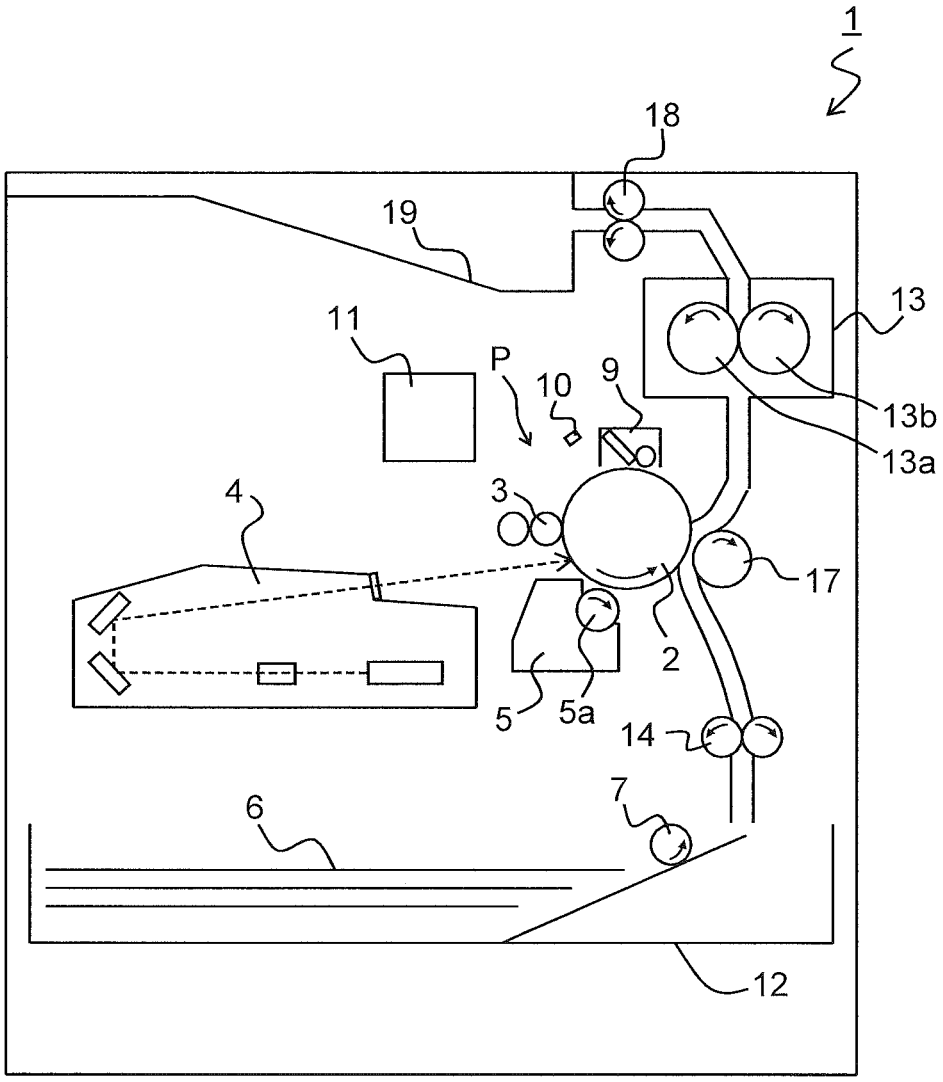
FIG. 1 is a schematic cross-sectional view showing the structure of an image forming apparatus provided with a paper dust collecting member according to one embodiment of the present disclosure.

An image forming apparatus 1 provided with a paper dust collecting member 20 according to one embodiment of the present disclosure will be described with reference to FIGS. 1 to 10. The left side of FIG. 1 corresponds to the front side of the image forming apparatus 1. As shown in FIG. 1, inside the image forming apparatus 1 (here, a monochrome printer), an image forming portion P is disposed. The image forming portion P forms a predetermined image through processes of charging, exposure, development, and transfer.

In the image forming portion P, a photosensitive drum (an image carrier) 2 that carries a visualized image (toner image) is disposed. The toner image formed on the photosensitive drum 2 is transferred to a sheet 6, and is then fixed to the sheet 6 by a fixing device 13. Then the sheet 6 is discharged from the image forming apparatus 1 main body. As the photosensitive drum 2 is rotated in the counter-clockwise direction in FIG. 1 by an unillustrated drum driving motor, an image forming process with respect to the photosensitive drum 2 is performed.

Next, the image forming portion P will be described in detail. Around and in front (to the left in FIG. 1) of the photosensitive drum 2 that is rotatably disposed, there are provided a charging roller 3 that electrostatically charges the photosensitive drum 2, an exposure unit 4 that exposes the photosensitive drum 2 to light carrying image information, a developing unit 5 that forms a toner image on the photosensitive drum 2, a cleaning device 9 that collects unused developer (toner) on the photosensitive drum 2, and a static eliminating device 10 that removes an electrostatic latent image.

The charging roller 3 electrostatically charges the surface of the photosensitive drum 2 uniformly, and then the exposure unit 4 irradiates it with light to form an electrostatic latent image based on an image signal on the photosensitive drum 2. The developing unit 5 has a developing roller 5*a* disposed so as to face the photosensitive drum 2. The developing unit 5 is charged with a predetermined amount of magnetic one-component positively charged toner by a toner container 11. The toner is fed to the surface of the photosensitive drum 2 by the developing roller 5*a*, and electrostatically attaches to the surface of the photosensitive drum 2 to form a toner image based on an electrostatic latent image formed through exposure to light from the exposure unit 4.

The sheet 6 to which the toner image is transferred is stored in a sheet feeding cassette 12 for storing sheets 6, and is conveyed via a sheet feeding roller 7 and a registration roller pair (conveying roller pair) 14 toward the photosensitive drum 2 on which the toner image has been formed. At a lower part of the photosensitive drum 2, by applying an electric field to the sheet 6 with a transfer roller 17 to which a predetermined transfer bias is applied, the toner image on the photosensitive drum 2 is transferred to the sheet 6.

The sheet 6 to which the toner image has been transferred is conveyed to the fixing device 13. In preparation for the subsequent formation of a new electrostatic latent image, the toner remaining on the surface of the photosensitive drum 2 after the transfer of the toner image is collected by the cleaning device 9. To the sheet 6 conveyed to the fixing device 13, the toner image is fixed under application of heat and pressure by a fixing roller 13*a* and a pressing roller 13*b*, and a predetermined image is formed on the sheet 6. Then, the sheet 6 on which an image has been formed is discharged onto a sheet discharge tray 19 by a discharge roller pair 18.

Next, the structure around the registration roller pair 14 will be described in detail.

The registration roller pair 14 is composed of, for example, a metal roller that is a driving roller and that is made of iron and a rubber roller that is a driven roller. These two rollers, by being disposed in parallel to and in pressed contact with each other, form a nip portion. The registration roller pair 14, when the distal end of the sheet 6 is put into contact with the nip portion, corrects a skew in the sheet 6. Being rotated by an unillustrated driving motor, the registration roller pair 14 conveys the sheet 6 to the image forming portion P in coordination with the timing of image formation.

Figure 2:
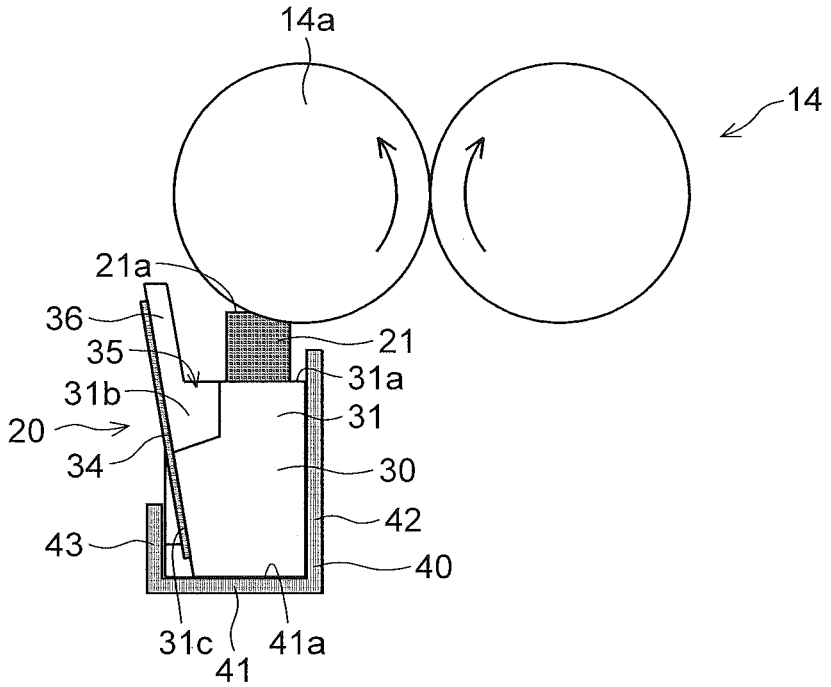
FIG. 2 is a cross-sectional view showing the structure of and around the paper dust collecting member according to the one embodiment of the present disclosure.

As shown in FIG. 2, under one conveying roller 14*a* (for example, a metal roller) of the registration roller pair 14, the paper dust collecting member 20 is provided that contacts with the conveying roller 14*a* to collect paper dust. The paper dust collecting member 20 extends in the axial direction of the conveying roller 14*a* (direction perpendicular to the plane of FIG. 2) and is formed to be removable along the axial direction of the conveying roller 14*a* with respect to the image forming apparatus 1 main body.

The paper dust collecting member 20 includes a removing member 21 comprising sponge or the like that collects paper dust attached to the conveying roller 14*a* by being disposed so as to contact with the outer circumferential surface of the conveying roller 14*a*, and a resin holding member 30 that holds the removing member 21. The removing member 21 is formed in the shape of a rectangular parallelopiped that extends in the axial direction of the conveying roller 14*a*, and is fixed to the holding member 30 with adhesive. The top surface (contact surface) 21*a* of the removing member 21 is a collection surface that contacts with the outer circumferential surface of the conveying roller 14*a* to collect paper dust.

Figure 3:
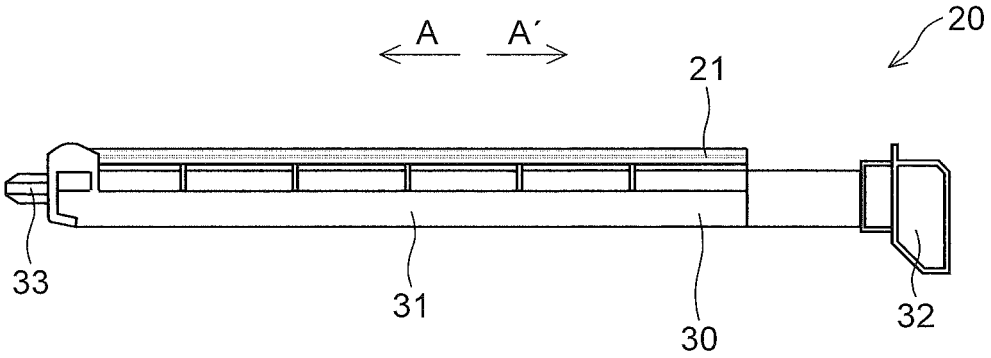
FIG. 3 is a diagram showing the structure of the paper dust collecting member according to the one embodiment of the present disclosure.

As shown in FIG. 3, the holding member 30 includes a holding portion 31 that extends in the axial direction (arrow AA' direction) of the conveying roller 14*a* and that holds the removing member 21, a grip portion 32 that is disposed in the arrow A' direction with respect to the holding portion 31 (on the upstream side in the attaching direction of the paper dust collecting member 20 with respect to the image forming apparatus 1 main body, on the rear end side of the holding member 30) and that is gripped by a user, and a boss portion 33 that is disposed in the arrow A direction with respect to the holding portion 31 (on the downstream side in the attaching direction, on the distal end side of the holding member 30) and that is positioned with respect to the image forming apparatus 1 main body. The grip portion 32 is provided in an upstream-side end part in the attaching direction of the holding member 30.

Figure 4:
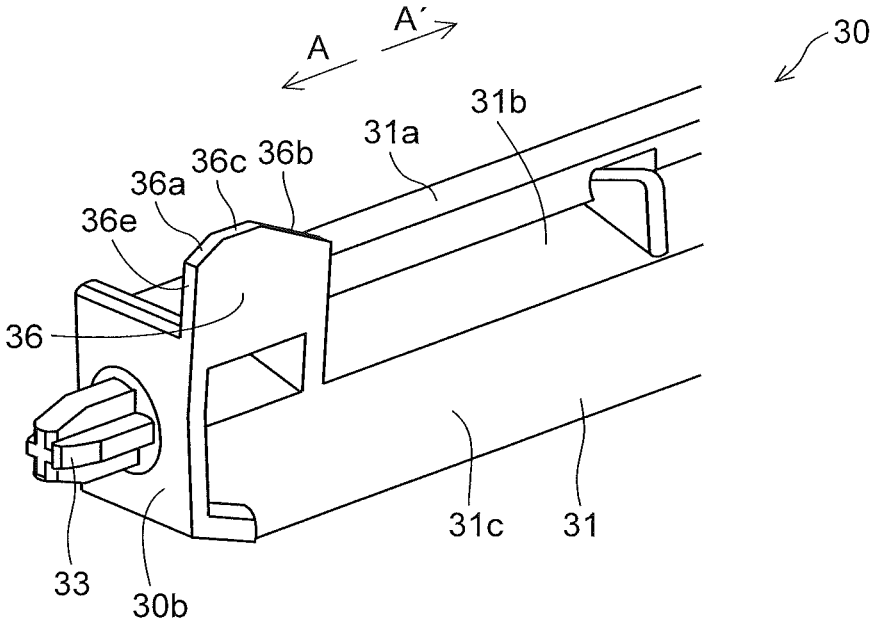
FIG. 4 is a perspective view showing the structure of and around a holding member in the paper dust collecting member according to the one embodiment of the present disclosure.
Figure 5:
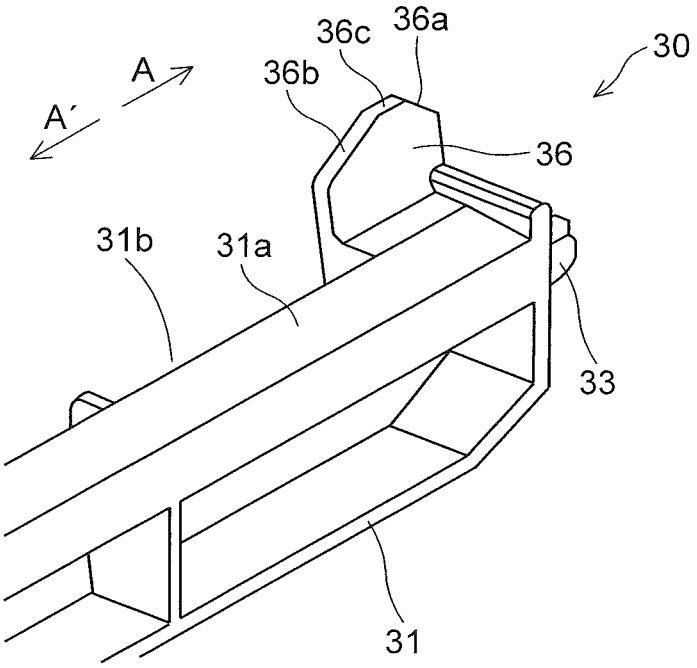
FIG. 5 is a perspective view showing the structure of and around a protrusion portion of the holding member of the paper dust collecting member according to the one embodiment of the present disclosure.

The holding portion 31 is so formed as to extend horizontally in parallel with the registration roller pair 14. As shown in FIGS. 2, 4, and 5, the holding portion 31 includes a mounting surface 31*a* to which the removing member 21 is fitted, a recessed portion 31*b* provided continuously with the left side of the mounting surface 31*a* in FIG. 2 (in the direction away from the nip portion of the registration roller pair 14), and a side surface 31*c* provided continuously with the left side of the recessed portion 31*b* in FIG. 2.

Figure 6:
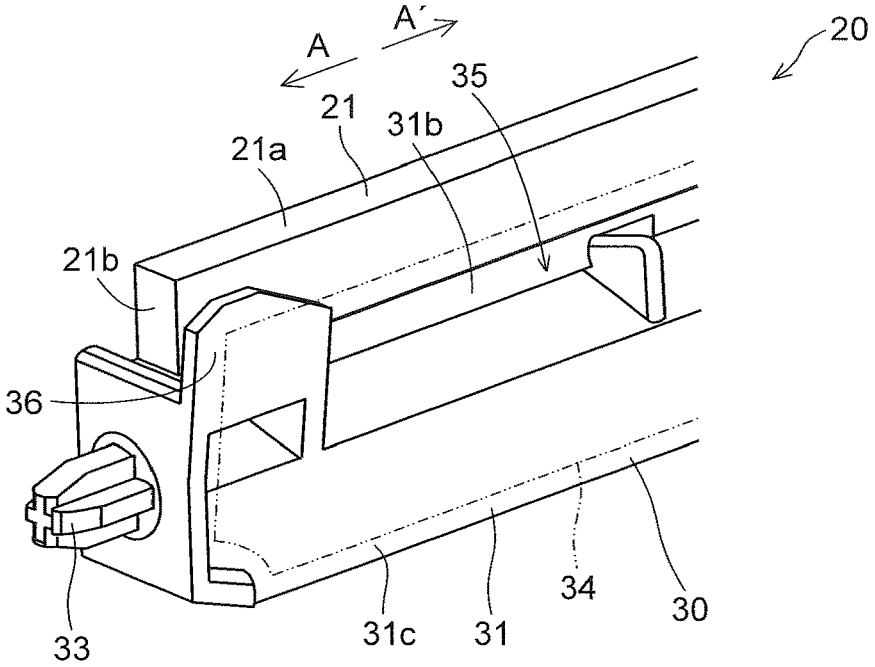
FIG. 6 is a perspective view showing the structure of and around the protrusion portion of the paper dust collecting member according to the one embodiment of the present disclosure.
Figure 7:
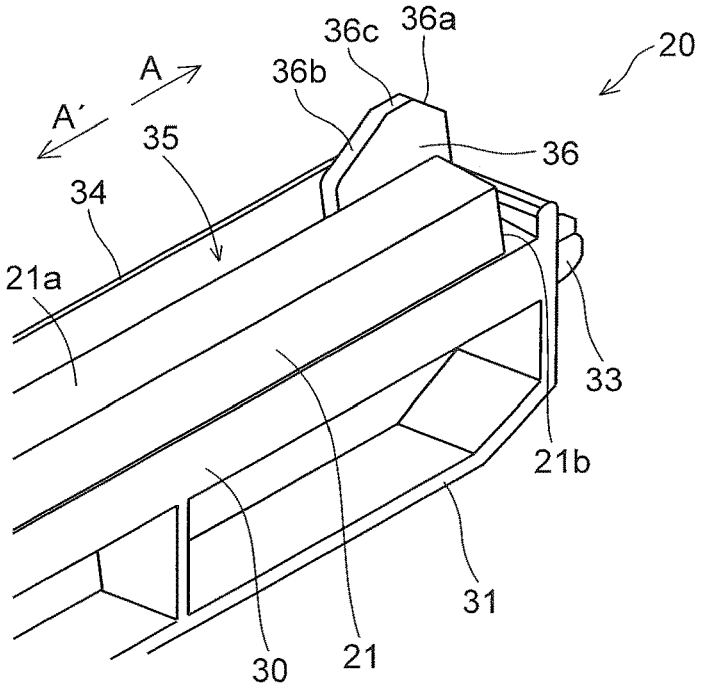
FIG. 7 is a perspective view showing the structure of and around the protrusion portion of the paper dust collecting member according to the one embodiment of the present disclosure.
Figure 9:
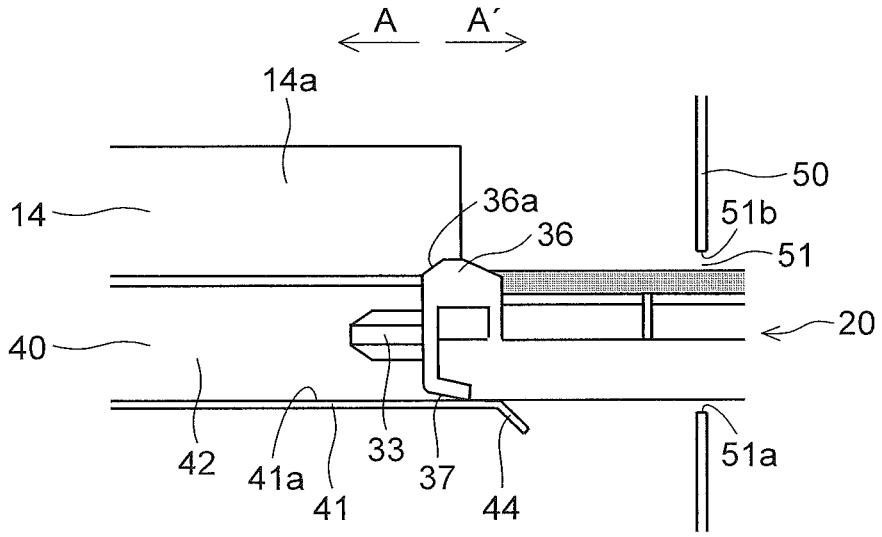
FIG. 9 is a diagram showing a state where the paper dust collecting member according to one embodiment of the present disclosure is in the middle of being attached to an image forming apparatus main body.
Figure 10:
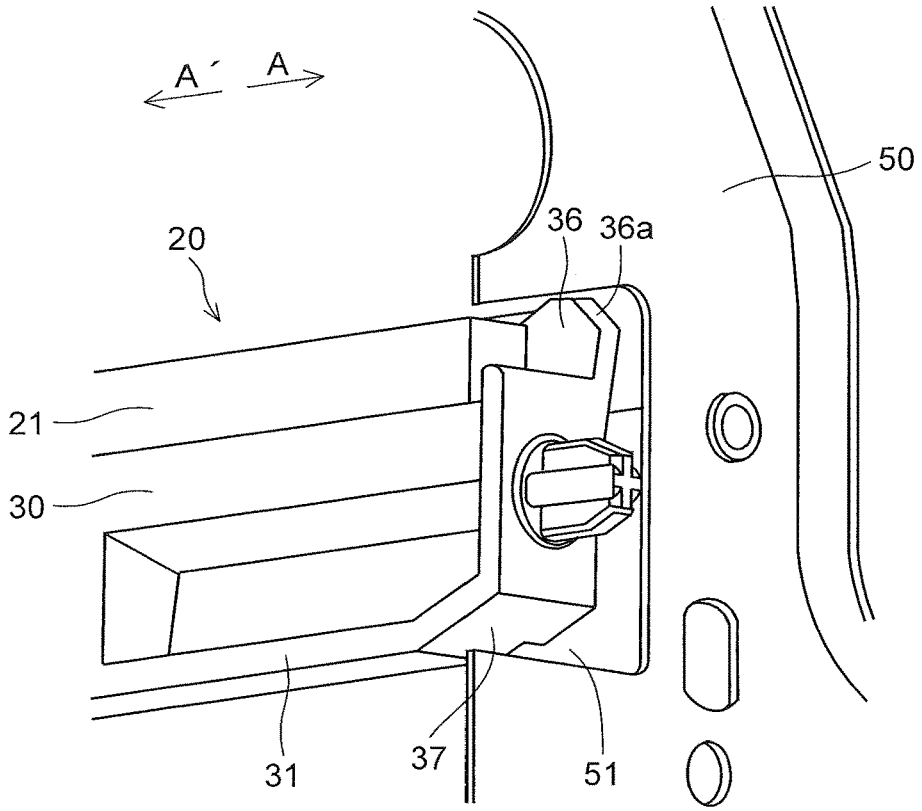
FIG. 10 is a perspective view showing a state where the paper dust collecting member according to the one embodiment of the present disclosure is being inserted in an opening portion in a side wall member.

As shown in FIGS. 2, 6, and 7, a resin film 34 is attached to the side surface 31*c*. The resin film 34 and the recessed portion 31*b* constitute a paper dust receiving portion 35 for receiving paper dust removed from the conveying roller 14*a* by the removing member 21. To facilitate understanding, the resin film 34 is indicated by a two-dot chain line in FIG. 6. In FIGS. 3 and 9, the resin film 34 is omitted.

Figure 8:
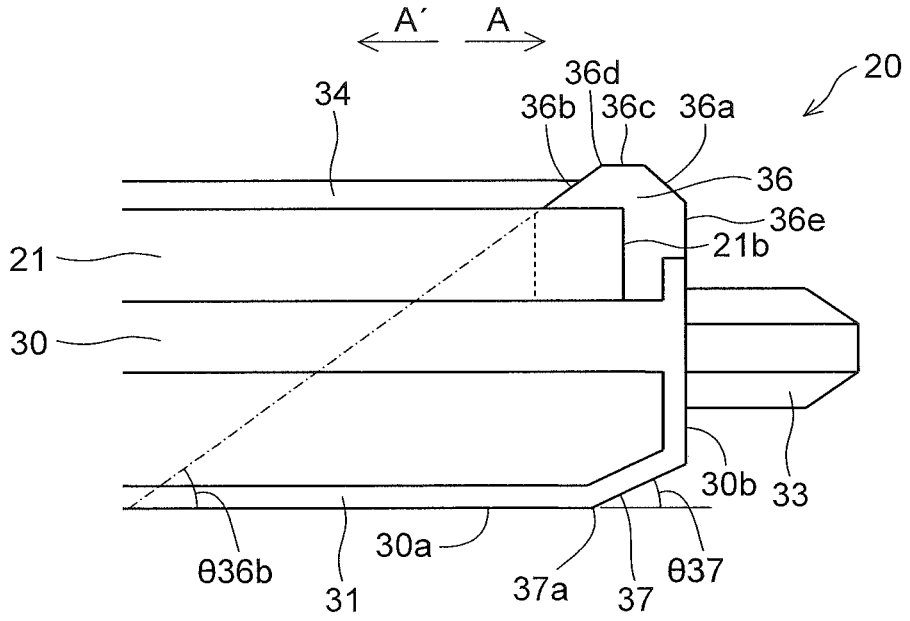
FIG. 8 is a diagram showing the structure of and around the protrusion portion of the paper dust collecting member according to the one embodiment of the present disclosure.

Here, in a downstream-side end part in the attaching direction of the holding member 30 (the distal end portion of the holding member 30) is provided with a protrusion portion 36 that protrudes upward (in the height direction perpendicular to the attaching direction, in the thickness direction of the removing member 21). As shown in FIG. 8, the protrusion portion 36 is disposed along a side surface of the removing member 21 so as to extend at least from a downstream end 21*b* of the removing member 21 to the downstream side (right side in FIG. 8) in the attaching direction. That is, the downstream end 36*e* of the protrusion portion 36 in the attaching direction is disposed on the downstream side (distal end side) of the downstream end (distal end) 21*b* of the removing member 21 in the attaching direction. The protrusion portion 36 protrudes above the top surface 21*a* of the removing member 21. In this embodiment, the protrusion portion 36 is disposed so as to extend from a position on the upstream side (left side in FIG. 8), in the attaching direction, of the downstream end 21*b* of the removing member 21 to the downstream side.

An upper end of the protrusion portion 36 has a flat-top inverted V shape (substantially inverted V shape) including a first inclined surface 36*a* that is disposed in a downstream-side end part in the attaching direction and that inclines downward toward the downstream side (right side in FIG. 8, the distal end side) in the attaching direction, a second inclined surface 36*b* that is disposed on the upstream side (left side in FIG. 8, the rear end side) of the first inclined surface 36*a* in the attaching direction and that inclines downward toward the upstream side (rear end side) in the attaching direction, and a level surface 36*c* that is disposed between the second inclined surface 36*b* and the first inclined surface 36*a*.

The downstream end (distal end) 21*b* of the removing member 21 in the attaching direction is disposed below the upper end (the first inclined surface 36*a*, the second inclined surface 36*b* and the level surface 36*c*) of the protrusion portion 36 as seen from the side perpendicular to the attaching direction (from the direction perpendicular to the plane of FIG. 8). In this embodiment, the downstream end 21*b* of the removing member 21 is disposed under the level surface 36*c* as seen from the side perpendicular to the attaching direction.

The holding member 30 is provided with a lower inclined surface 37 that inclines downward from a lower end edge of the downstream-side end part (a distal end surface 30*b*) of the holding member 30 in the attaching direction toward the upstream side (rear end side) in the attaching direction. An upstream end (lower edge) 37*a* of the lower inclined surface 37 in the attaching direction is disposed on the upstream side (left side in FIG. 8, the distal end side) in the attaching direction of the downstream end (an upper end) 36*d* of the second inclined surface 36*b* in the attaching direction. The inclination angle θ36*b* of the second inclined surface 36*b* with respect to the bottom surface 30*a* (the bottom surface of the holding portion 31) and the mounting surface 31*a* of the holding member 30 is larger than the inclination angle θ37 of the lower inclined surface 37 with respect to the bottom surface 30*a* and the mounting surface 31*a* of the holding member 30.

As shown in FIGS. 2 and 9, a guide member 40 that guides the paper dust collecting member 20 is provided along the conveying roller 14*a*. The guide member 40 includes a bottom surface portion 41 that has a supporting surface (bottom surface) 41*a* that supports the paper dust collecting member 20, a side surface portion 42 that is erect from the right end (edge in the direction toward the nip portion of the registration roller pair 14) of the bottom surface portion 41 in FIG. 2, and a side surface portion 43 that is erect from the left end of the bottom surface portion 41 in FIG. 2. As shown in FIG. 9, in an end part of the bottom surface portion 41 in the arrow A' direction, an inclined portion 44 for helping insertion of the paper dust collecting member 20 is provided.

As shown in FIG. 9, on the upstream side (arrow A' direction) in the attaching direction with respect to the registration roller pair 14 and the guide member 40, there is provided a side wall member (side plate) 50 (see also FIG. 10) that has an opening portion 51 through which the paper dust collecting member 20 can pass. A lower edge portion 51*a* of the opening portion 51 is disposed slightly below the supporting surface 41*a* of the guide member 40.

In the image forming apparatus 1, when replacing the paper dust collecting member 20, a user pulls out the paper dust collecting member 20 along the guide member 40 in the arrow A' direction. A new paper dust collecting member 20 is then inserted in the opening portion 51 in the side wall member 50. Here, the first inclined surface 36*a* and the lower inclined surface 37 help the distal end portion of the paper dust collecting member 20 slide into the opening portion 51. The distal end of the removing member 21 (downstream end 21*b*) is protected by the protrusion portion 36, and thus it does not contact with an upper edge portion 51*b* of the opening portion 51.

The paper dust collecting member 20 is inserted with the bottom surface 30*a* sliding on the lower edge portion 51*a* of the opening portion 51, and is guided by the inclined portion 44 of the guide member 40 to the bottom surface portion 41. The paper dust collecting member 20 is then inserted along the bottom surface portion 41, the side surface portion 42 and the side surface portion 43, and is positioned as the boss portion 33 is inserted in a positioning hole (unillustrated) provided in the image forming apparatus 1 main body. In this way, the paper dust collecting member 20 is fitted to the image forming apparatus 1 main body.

In this embodiment, as described above, the holding member 30 has the protrusion portion 36 that is disposed, on its distal end portion side, along the side surface of the removing member 21 and that protrudes upward. The protrusion portion 36 protrudes upward beyond the top surface 21*a* of the removing member 21. With this, when a new paper dust collecting member 20 is inserted in the image forming apparatus 1 main body for replacement of the paper dust collecting member 20, the protrusion portion 36 protects the distal end (downstream end 21*b* in the inserting direction) of the removing member 21 to prevent the distal end of the removing member 21 from contacting with the opening portion 51 in the image forming apparatus 1 main body. With this, it is possible to prevent the removing member 21 itself from being damaged or the removing member 21 from coming off from the holding member 30.

As described above, the upper end of the protrusion portion 36 has the first inclined surface 36*a* that inclines downward toward the downstream side (distal end side) in the attaching direction. With this, when the paper dust collecting member 20 is inserted, the first inclined surface 36*a* guides it into the opening portion 51 in the image forming apparatus 1 main body, and this makes it easy to insert the paper dust collecting member 20 in the opening portion 51 in the image forming apparatus 1 main body.

As described above, the holding member 30 is provided with the lower inclined surface 37 that inclines downward from the lower end edge of the distal end surface 30*b* of the holding member 30 in the attaching direction toward the upstream side (rear end side) in the attaching direction. This makes it even easier to insert the paper dust collecting member 20 in the opening portion 51 in the image forming apparatus 1 main body.

As described above, the upstream end 37*a* of the lower inclined surface 37 is disposed on the upstream side (arrow A' direction), in the attaching direction, of the downstream end 36*d* of the second inclined surface 36*b*. That is, the bottom surface 30*a* located at the lowest position of the holding member 30 and the level surface 36*c* located at the highest position of the protrusion portion 36 do not overlap in the attaching direction. With this, unlike in a case where the upstream end 37*a* of the lower inclined surface 37 is disposed on the downstream side (arrow A direction), in the attaching direction, of the downstream end 36*d* of the second inclined surface 36*b* (a case where the bottom surface 30*a* and the level surface 36*c* overlap in the attaching direction), it is possible to make the length in the up-down direction of the holding member 30 at any position in the attaching direction smaller than the length between the bottom surface 30*a* and the level surface 36*c*, and this helps reduce difficulty inserting the paper dust collecting member 20 in the opening portion 51 in the image forming apparatus 1 main body.

As described above, the inclination angle 936*b* of the second inclined surface 36*b* with respect to the mounting surface 31*a* of the holding member 30 is larger than the inclination angle 937 of the lower inclined surface 37 with respect to the mounting surface 31*a* of the holding member 30. With this, the length of the holding member 30 in the up-down direction at any position in the attaching direction is largest at the downstream end 36*d* of the second inclined surface 36*b*. That is, when the paper dust collecting member 20 is inserted in the opening portion 51 in the image forming apparatus 1 main body, after the downstream end 36*d* of the second inclined surface 36*b* has passes the opening portion 51, the space between the holding member 30 and the opening portion 51 becomes gradually larger, and this makes it even easier to insert the paper dust collecting member 20 in the opening portion 51.

As described above, the protrusion portion 36 has the level surface 36*c* that is disposed between the second inclined surface 36*b* and the first inclined surface 36*a*, and the downstream end 21*b* of the removing member 21 is disposed under the level surface 36*c* as seen from the side perpendicular to the attaching direction. With this, even if the position for attaching the removing member 21 slightly deviates in the longitudinal direction (arrow AA' direction), the protrusion portion 36 can reliably protect the distal end of the removing member 21.

As described above, the protrusion portion 36 is disposed so as to extend from a position on the upstream side, in the attaching direction, of the downstream end 21*b* of the removing member 21 to the downstream side. With this, the protrusion portion 36 can reliably protect the distal end of the removing member 21.

As described above, the lower edge portion 51*a* of the opening portion 51 is disposed below the supporting surface 41*a* for supporting the paper dust collecting member 20 in the guide member 40. With this, after the protrusion portion 36 has passed through the opening portion 51, the paper dust collecting member 20 is moved upward by the guide member 40, and thus it is possible to prevent the protrusion portion 36 from contacting with the upper edge portion 51*b* of the opening portion 51. This makes it even easier to insert the paper dust collecting member 20 in the opening portion 51.

The registration roller pair 14 is especially prone to generate paper dust, and thus, as described above, providing the paper dust collecting member 20 of the present disclosure for removing paper dust from the registration roller pair 14 is especially effective.

The embodiments disclosed above should be understood to be in every aspect illustrative and not restrictive. The scope of the present disclosure is defined not by the description of the embodiments given above but by the appended claims, and should be understood to encompass any modifications made in the sense and scope equivalent to those of the claims.

For example, while the above embodiments deal with an example where the present disclosure is applied to a monochrome printer, this is not meant to limit the present disclosure. Needless to say, the present disclosure can be applied to various image forming apparatuses such as color printers, monochrome copiers, digital multifunction peripherals, and facsimile machines provided with a roller pair for conveying sheets and a paper dust collecting member for collecting paper dust attached to the roller pair.

For another example, while the above embodiments deal with an example where the paper dust collecting member 20 is configured to collect paper dust attached to the registration roller pair, this is in no way meant to limit the present disclosure. Instead, it is possible to configure the paper dust collecting member 20 to collect paper dust attached to a conveying roller pair other than the registration roller pair.

For another example, while the above embodiments deal with an example where the protrusion portion 36 is provided so as to extend from a position on the upstream side, in the attaching direction, of the downstream end 21*b* of the removing member 21 to the downstream side, this is in no way meant to limit the present disclosure. Instead, the protrusion portion 36 may be disposed so as to extend from the downstream end 21*b* of the removing member 21 to the downstream side.

For another example, while the above embodiments deal with an example where the first inclined surface 36*a*, the second inclined surface 36*b*, and the lower inclined surface 37 are provided in the holding member 30, this is not meant to limit the present disclosure. Instead, one or more of the first inclined surface 36*a*, the second inclined surface 36*b*, and the lower inclined surface 37 do not necessarily need to be provided.

For another example, while the above embodiments deal with an example where the level surface 36*c* is provided on the protrusion portion 36, the level surface 36*c* does not necessarily need to be provided on the protrusion portion 36.

Figure 11:
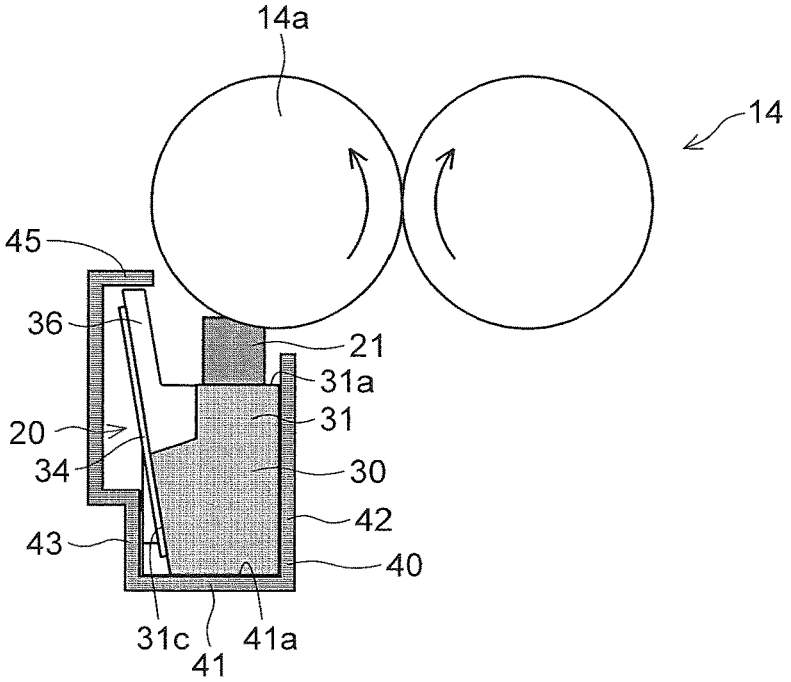
FIG. 11 is a cross-sectional view showing the structure of and around the paper dust collecting member according to a modified example of the one embodiment of the present disclosure.

For another example, it is possible to configure the guide member 40, for example, as in the modified example of the present disclosure shown in FIG. 11. That is, it is possible to provide a top surface portion 45 for regulating the upper end position of the protrusion portion 36 at least in an upstream-side end part of the guide member 40 in the attaching direction. With this configuration, it is possible to regulate the distal end portion (downstream-side end part in the attaching direction) of the paper dust collecting member 20 so as not to move upward after the protrusion portion 36 reaches the guide member 40. In this way, it is possible to prevent the distal end (downstream end 21*b*) of the removing member 21 from abutting hard on the end portion of the conveying roller 14*a*. The top surface portion 45 may be provided over the entire guide member 40 in the longitudinal direction.

Any configurations achieved by combining the configurations of the embodiments and modified examples described above are also within the technical scope of the present disclosure.

What is claimed is:

1. A paper dust collecting member which is disposed in an apparatus main body and removes and collects paper dust attached to a conveying roller, the paper dust collecting member being attachable along an attaching direction parallel to an axial direction of the conveying roller via an opening portion provided in a side plate of the apparatus main body, the paper dust collecting member comprising;

a removing member which extends in the axial direction of the conveying roller and which removes the paper dust by being disposed so as to contact with an outer circumferential surface of the conveying roller; and a holding member which holds, on a mounting surface thereof, the removing member, wherein the removing member includes a contact surface which makes contact with the outer circumferential surface of the conveying roller, the holding member includes a protrusion portion which is disposed, on a distal end portion side thereof, along a side surface of the removing member and which protrudes in a thickness direction of the removing member, the protrusion portion protrudes beyond the contact surface of the removing member in the thickness direction, an upper edge of the protrusion portion has a first inclined surface which inclines downward toward a distal end side in the attaching direction, the holding member is provided with a lower inclined surface which inclines downward from a lower edge of a distal end surface toward a rear end side in the attaching direction, the protrusion portion further includes a second inclined surface which inclines downward from a rear end of the first inclined surface toward the rear end side, and a lower edge of the lower inclined surface is disposed closer to the distal end side than an upper end of the second inclined surface in the attaching direction.

2. The paper dust collecting member according to claim 1, wherein an inclination angle of the second inclined surface with respect to the mounting surface of the holding member is larger than an inclination angle of the lower inclined surface with respect to the mounting surface of the holding member.

3. The paper dust collecting member according to claim 1, wherein the protrusion portion further includes a level surface disposed between the first inclined surface and the second inclined surface, and a distal end of the removing member is disposed under the level surface as seen from a side perpendicular to the attaching direction.

4. The paper dust collecting member according to claim 1, wherein a distal end of the protrusion portion is disposed closer to the distal end side than a distal end of the removing member in the attaching direction.

5. An image forming apparatus, comprising:

the paper dust collecting member according to claim 1;

a roller pair including the conveying roller from which paper dust is removed by the paper dust collecting member; and a guide member which is disposed along the conveying roller and which guides the paper dust collecting member.

6. The image forming apparatus according to claim 5, wherein a lower edge portion of the opening portion is disposed below a bottom surface of the guide member.

7. A paper dust collecting member which is disposed in an apparatus main body and removes and collects paper dust attached to a conveying roller, the paper dust collecting member being attachable along an attaching direction parallel to an axial direction of the conveying roller via an opening portion provided in a side plate of the apparatus main body, the paper dust collecting member comprising:

a removing member which extends in the axial direction of the conveying roller and which removes the paper dust by being disposed so as to contact an outer circumferential surface of the conveying roller; and a holding member having a mounting surface facing the conveying roller, the holding member holding, on the mounting surface thereof, the removing member, wherein the removing member includes a contact surface which makes contact with the outer circumferential surface of the conveying roller, the holding member includes a protrusion portion which is disposed, on a distal end portion side thereof, along a side surface of the removing member and which protrudes in a thickness direction of the removing member, and the protrusion portion protrudes beyond the contact surface of the removing member in a direction perpendicular to the mounting surface.

8. A paper dust collecting member which is disposed in an apparatus main body and removes and collects paper dust attached to a conveying roller, the paper dust collecting member being attachable along an attaching direction parallel to an axial direction of the conveying roller via an opening portion provided in a side plate of the apparatus main body, the paper dust collecting member comprising:

a removing member which is formed in a cuboid shape extending in the axial direction of the conveying roller and which removes the paper dust by being disposed so as to contact an outer circumferential surface of the conveying roller; and a holding member which fixes, to a mounting surface thereof, the removing member with adhesive, wherein the removing member includes a contact surface which makes contact with the outer circumferential surface of the conveying roller, the holding member includes a protrusion portion which is disposed, on a distal end portion side thereof, along a side surface of the removing member and which protrudes in a thickness direction from the mounting surface toward the contact surface of the removing member, and the protrusion portion protrudes beyond the contact surface of the removing member in the thickness direction.

* * * * *